US005823919A

United States Patent [19]

Eschenbach

[11] Patent Number: 5,823,919

[45] Date of Patent: Oct. 20, 1998

[54] STANDUP EXERCISE MACHINE WITH ARM EXERCISE

[76] Inventor: Paul William Eschenbach, 143 Lakeland Ave., Moore, S.C. 29369

[21] Appl. No.: 614,823

[22] Filed: Mar. 7, 1996

[51] Int. Cl.[6] ..... A63B 69/16; A63B 22/00

[52] U.S. Cl. ..... 482/62; 482/57

[58] Field of Search ..... 482/51, 52, 53, 482/57, 62, 70, 58–59

[56] References Cited

U.S. PATENT DOCUMENTS

| | | | |
|---|---|---|---|
| 4,664,400 | 5/1987 | Date | 482/51 |
| 4,961,569 | 10/1990 | Roberge | 482/62 |
| 5,039,088 | 8/1991 | Shifferaw | 482/57 |
| 5,279,529 | 1/1994 | Eschenbeck | 482/51 |
| 5,290,211 | 3/1994 | Stearns | 482/70 |
| 5,290,212 | 3/1994 | Metcalf | 482/62 |
| 5,423,728 | 6/1995 | Goldberg | 482/57 |
| 5,423,729 | 6/1995 | Eschenbeck | 482/70 |
| 5,431,614 | 7/1995 | Jeranson | 482/57 |
| 5,529,555 | 6/1996 | Rodgers | 482/57 |
| 5,562,574 | 10/1996 | Miller | 482/51 |
| 5,577,985 | 11/1996 | Miller | 482/52 |

*Primary Examiner*—Stephen R. Crow

[57] ABSTRACT

An exercise apparatus is provided that simulates jogging, running and climbing with vigorous arm exercise. Three modes of cycling exercise are provided with the operator in a stand-up position. Stand-up cycling occurs while the feet operate position controlled pedals and the hands grasp a handlebar. Cruise cycling has the operator inclined forward with the lower arms resting on a handlebar and foot straps to encourage leg lifts for additional speed of operation. Push-up arm exercise occurs with the body inclined forward where the arm levers support a significant portion of the body weight.

20 Claims, 4 Drawing Sheets

STANDUP EXERCISE MACHINE WITH ARM EXERCISE

BACKGROUND OF THE INVENTION

1. Field

The present invention relates to a standup exercise apparatus that simulates jogging, running and climbing with arm exercise. More particularly, the present invention relates to an exercise machine having separately supported pedals for the feet and push-up arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

The sit down exercise cycle is the most commonly used apparatus today to elevate the heart rate and exercise some of the leg muscles. To achieve any significant benefit, however, an extensive amount of time is demanded of the user resulting in boredom. The Lifecycle, U.S. Pat. No. 4,358,105 leads a popular trend to reduce the boredom of sit down cycling by offering programmed load resistance change over many minutes of cycling and a clever display to capture the attention of the user. More recently, computers interface with the user to vary the exercise routine. However, the issue of extensive time, limited muscle usage and vigorous arm exercise are not addressed.

Hand cranks and levers have long been applied to arm exercise. More recently, Hegel in U.S. Pat. No. 4,060,241 uses a simple hand crank and friction brake while Cosby et al. in U.S. Pat. No. 4,521,012 use an adjustable length crank and hydraulic pump for standup exercise. Giannelli et al. in U.S. Pat. No. 4,582,318 also shows a hand crank to drive a hydraulic pump with one-way clutches. Duggan in U.S. Pat. No. 4,749,182 again uses a hand crank to drive a flywheel having foot adjustable load resistance.

Heilbrun in U.S. Pat. No. 4,355,633 use powered rotary cranks for various position related passive exercise. Gause et al. in U.S. Pat. No. 3,744,480 claim an ergometer that can be operated in a prone position using a hand crank located below a body supporting platform.

Swing arms for arm exercise are used by Carlson et al. in U.S. Pat. No. 4,772,015 to arm wrestle while Carlson in U.S. Pat. No. 4,720,099 adapts swing arms for a variety of arm and leg motions in one machine. Iams et al. in U.S. Pat. No. 4,674,740 applies spring loaded handles in a prone platform supporting position to simulate the arm motion of swimming. Berne in U.S. Pat. No. 2,921,791 and McGillis et al. in U.S. Pat. No. 4,872,668 use articulated arms for various arm exercise.

Numerous combinations of levers and cranks to combine exercise for arms and feet can be found. Hex in U.S. Pat. No. 4,645,200 combines arm and foot levers for s it down exercise while Bull et al. in U.S. Pat. No. 4,940,233 combines arm and foot levers for standup exercise.

Ruden in U.S. Pat. No. 1,344,963 combines separate hand cranks with a foot crank and cam operated abdomen exercise. Hand and foot cranks are combined by Nies in U.S. Pat. No. 3,572,699 with speed variations. Zent in U.S. Pat. No. 3,213,852 varies the angular relationship between left and right cranks by motor drive. Kepiro in U.S. Pat. No. 4,881,732 combines cranks with a clutch drive. Figueroa in U.S. Pat. No. 4,423,863 provides independent hand and foot cranks.

Zent in U.S. Pat. No. 4,071,235 combines cranks with a disc brake for sit down exercise. Morgan in U.S. Pat. No. 3,601,395 has independent cranks where the handlebar rotates against a friction brake. Kurlytes et al. in U.S. Pat. No. 4,693,468 provides independent spring loaded cranks for standup exercise. Aronsohn in U.S. Pat. No. 3,017,180 uses hand cranks on either side of the user for sit down pedal exercise. Sbarra in U.S. Pat. No. 2,783,044 shows coupled cranks with tension adjustment in the handle. Quellette in Canadian Pat. No. 730,035 shows independent cranks where the hand crank is on a swing arm located by detent.

Odom in U.S. Pat. No. 3,216,722 couple adjustable length cranks. DeBoer in U.S. Pat. No. 4,705,269 couples cranks using ratcheted sprockets. Ashworth in U.S. Pat. No. 4,618,141 couples the cranks with different size sprockets to change hand phasing for sit down exercise. Huang in U.S. Pat. No. 4,842,269 uses independent cranks which follow a geared track in sit down exercise.

Arm levers combined with a foot crank for sit down exercise has grown popular in the last 20 years of fitness. Glaser in U.S. Pat. No. 3,727,913 shows reciprocating handle and seat coupled to a foot crank. Yount et al. in U.S. Pat. No. 3,759,512 shows spring loaded arm levers and foot crank. Mester in U.S. Pat. No. 3,966,201 provides independent levers with a foot crank for various sit down exercise. Hooper in U.S. Pat. No. 4,188,030 couples a pair of swing arms to a foot crank with a crank eccentric for sit down exercise having air resistance.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

In recent years, stair climbers have become very popular due to the higher loading possible with standup exercise as well as different muscles used compared to sit down exercise. The Stairmaster U.S. Pat. No. 4,708,338 is one of the most popular stair climbers allowing up and down independent parallel foot pedal movement with programmed load variation over multiple cycles as well as a clever display to hold the attention of the user. Young et al. in U.S. Pat. No. 4,989,858 adds arm levers to the stair climber concept for arm exercise.

Standup pedaling approaches the benefits of running to the cardiovascular system because a higher load resistance is possible over sit down cycling. Dr. Cooper in his book entitled THE AEROBICS PROGRAM FOR TOTAL WELL-BEING by Dr. Kenneth Cooper, Bantam Books, New York, 1982 awards only half the benefit points to sit down stationary cycling (page 260) over regular cycling which includes an equal amount of uphill and down hill course (page 255). Dr. Cooper grades running better than regular cycling, but without the downhill rest inherent in regular cycling, it is certain that standup cycling with vigorous arm exercise would exceed running for cardiovascular benefits in less time.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika, Ala. where pedal platforms move by crank motion but remain parallel to the floor.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. None of the pedal operated exercise machines anticipate arm exercise with the operator in a standup position where an appreciable amount of body weight is supported by the arms.

There is a need for a pedal operated exercise machine that can be safely operated in the standup position whereby the arms can be exercised in a push-up motion.

SUMMARY OF THE INVENTION

The present invention relates to the kinematic motion control of pedals which simulate running, climbing and cycling during three modes of operation wherein one mode of operation has vigorous arm exercise where the arms support part of the body weight. More particularly, apparatus is provided that offers variable intensity exercise through a leg operated cyclic motion in which the pedal supporting each foot is guided through successive positions during the motion cycle while a load resistance acts upon the mechanism. Three positions of operation are offered the operator wherein the hands grasp different handles for the three modes of cycling; stand-up, cruise and push-up. During push-up cycling, the body of the operator leans forward of the foot pedals whereby two swing arms support a portion of the body weight for vigorous arm exercise.

In the preferred embodiment, the apparatus includes a separate pedal for each foot, each partially supported by a rotary crank which completes one full revolution during a cycle and is phased approximately 180 degrees relative to the crank for for the other pedal through a bearing journal attached to the framework. The pedals are extended by a pedal support member and pivotally supported on the pedal extension by rocker arms which are rotatably connected to an upright support member of the framework. The crank, pedal with extension and rocker arm form a four-bar linkage known in the literature as a crank-rocker mechanism where the pedal with extension is the coupler link.

In another embodiment, the pedal is inclined and supported by two rocker arms for each foot wherein each foot moves in a pendulum or swinging motion with the leg raised and knee bent to initiate the downward cycle stroke. The leg becomes fully extended in the lowermost pedal position and ending the down stroke with the leg behind the operator slightly bent at the knee. To return the pedal for the upstroke portion of the cycle, a foot strap is provided on each pedal. The pedal and two rocker arms form a four bar linkage known in the literature as a double rocker mechanism where the pedal is the coupler link.

Both embodiments have arm levers that provide push-up arm exercise. The arm levers are pivoted above the pedals to move generally inclined up and down to provide push-up arm exercise. In the preferred embodiment, the rocker arms which support the pedal extension extend upward at an angle and forward of the operators upper body. In the alternate embodiment, the arm levers are again forward of the upper body of the operator and extend downward at an angle past a pivot connection to the framework to a link which couples the arm levers to one of the pedal rocker arm supports. During push-up exercise, the arm levers support a significant portion of the body weight while the body of the operator is significantly inclined as the pedals move in a generally back and forth direction.

For stand-up exercise a handlebar is adjustably connected to the framework to provide hand grips during operation. For cruise cycling, another hand grip extends forward of the handlebar such that the operator can lean forward resting the lower arms on the handlebar with hands grasping the forward hand grip. This allows the arms to support part of the body weight for speed or cruise cycling. Foot straps are provided on the pedals to allow leg lifts during pedal operation which increases the force acting upon the lower arms.

Load resistance is applied to the crank in the preferred embodiment by a sprocket which drives a chain to a smaller sprocket attached to a rotating flywheel supported by the framework. The alternate embodiment also uses a flywheel supported by the frame for load resistance but is alternately driven through one way clutches by sprockets on each side of the flywheel each connected by chain to larger sprockets which are attached to one of the rocker arms for each pedal. In either embodiment, the flywheel must overcome the frictional force provided by disc brake pads on either side of the flywheel. Adjustment of the pad force upon the flywheel provides variable intensity exercise for the operator.

In summary, this invention provides the operator with stable foot pedal support having motions that simulate running, climbing and cycling with very low joint impact while offering three different upper body positions and vigorous push-up arm exercise.

DETAILED DESCRIPTION OF THE EMBODIMENTS

Figure 1:
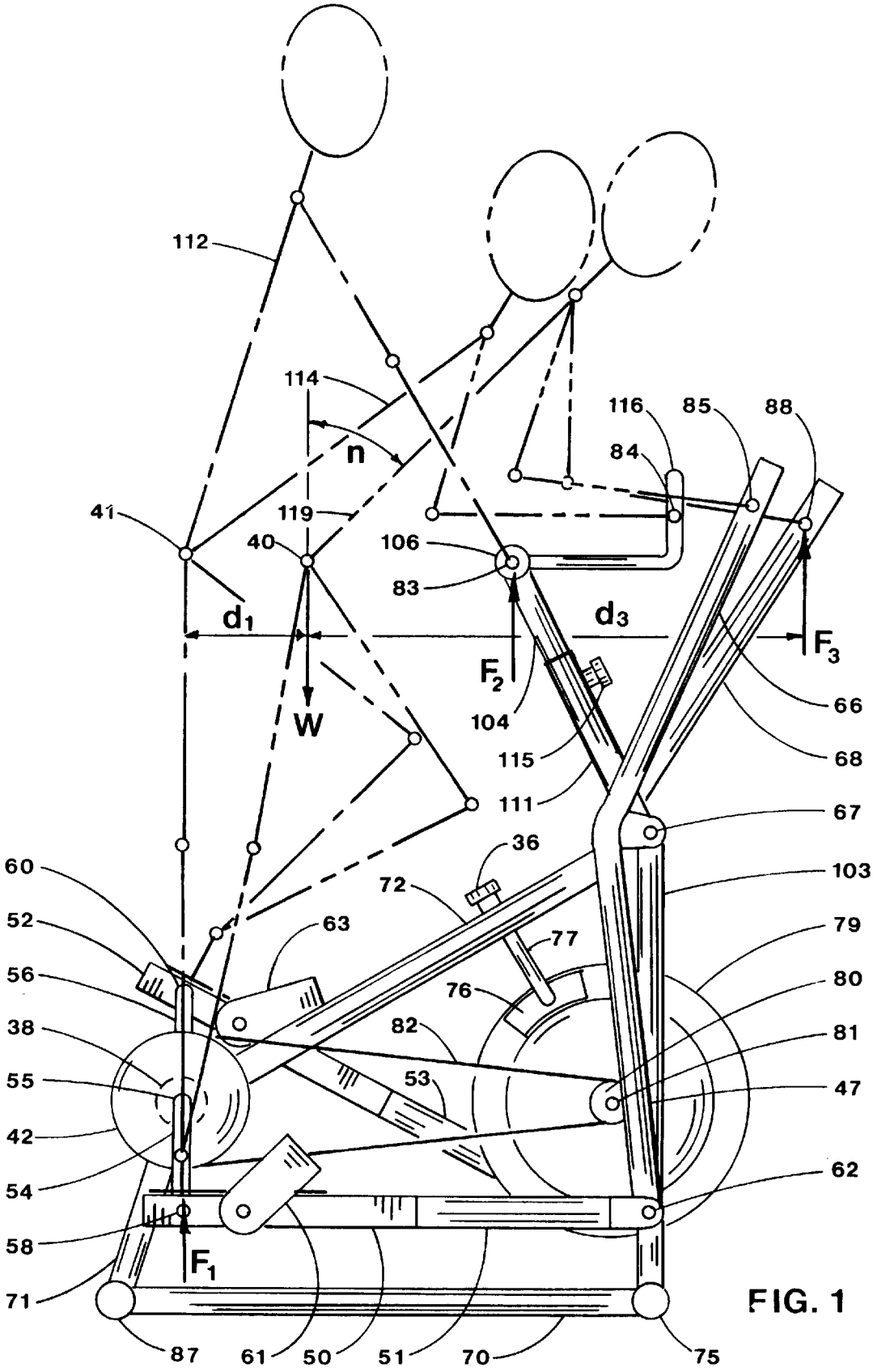
FIG. 1 is a right side elevation view of the preferred embodiment of an exercise machine constructed in accordance with the present invention.
Figure 2:
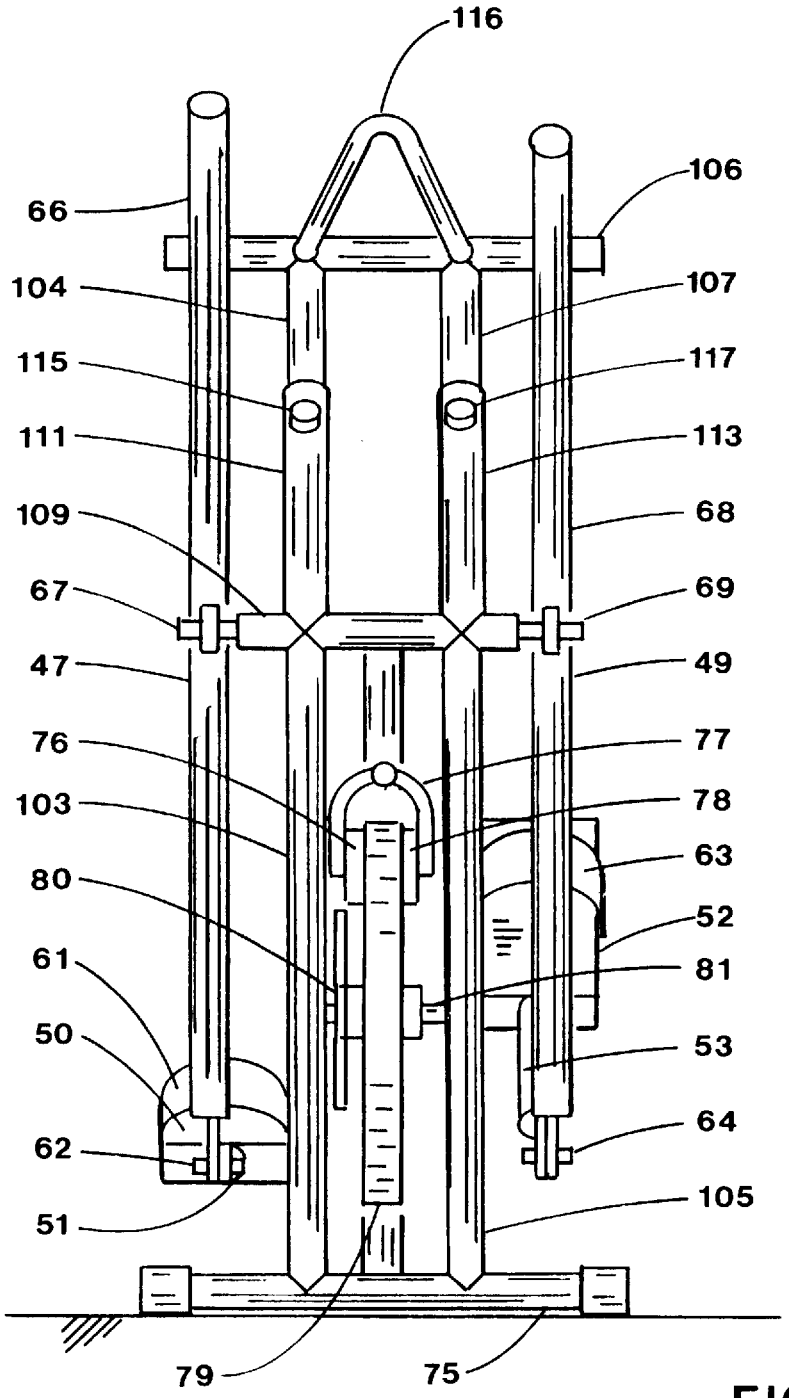
FIG. 2 is the front view of the preferred embodiment shown in FIG. 1.

Referring to the drawings in detail, pedals 50 and 52 are shown in FIGS. 1 and 2 in the lowest and highest positions, respectively. Crank 54 is rotatably attached to pedal 50 by crank pin 58 while crank 56 is rotatably attached to pedal 52 by crank pin 60. Cranks 54 and 56 are connected by crankshaft journal 55 which is rotatably secured to to bearing housing 38. Pedals 50 and 52 are covered with non-slip material to ensure foot contact and have foot straps 61 and 63 attached to allow leg lifts for additional exercise.

Rocker arms 47 and 49 are rotatably attached to pedal extensions 51 and 53 with pin bushings 62 and 64, and rotatably attached to the upright support cross member 109 by pin bushings 67 and 69, respectively. Rocker arms 47 and 49 are extended upward at an angle forward of the operator beyond pin bushings 67 and 69 to provide push-up arm exercise for user position 119 as arm levers 66 and 68.

The upright support cross member 109 is attached to upright supports 103 and 105 and frame support 72. Lower cross member 75 is in contact with the floor and is attached to upright supports 103 and 105 and is attached to horizontal support 70. A second lower cross member is in contact with the floor and is attached to support member 70 and 71. The bearing housing 38 is attached to support 71 and support 72.

Handlebar 106 is attached to support members 104 and 107 which are telescoped into supports 111 and 113 and held secure by detents 115 and 117. Supports 111 and 113 are attached at an angle to the horizontal to upright cross member 109. Handlebar 106 is adjustable in location to facilitate operator positions 112 and 114.

In operator position 112 the hip joint 41 is generally above or forward the crank bearing housing 38 while the arms are extended with the hands 83 gripping handlebar 106 causing the back to be somewhat inclined for stand-up cycling. A second operator position 114 is available wherein the operator leans forward to incline the back where the lower arms rest on handlebar 106 while the hands 84 grasp the hand grip 116 which is attached to handlebar 106. The handlebar 106 supports a more significant part of the body weight in position 114 to encourage speed or cruise cycling. The third position 119 of the operator has the hip joint 40 located a distance d1 forward of the foot on pedal position 50 and the hands 85 and 88 grasping the arm levers 66 and 68 at an average distance d3 from hip joint 40 such that the arm levers support more of the body weight W for push-up exercise cycling.

In the push-up position 119, the body weight W is generally centered near the hip joint 40 acting as a center of gravity. The feet are supported by force F1 while the hands 85 and 88 are supported by force F3. A simple force and moment analysis reveal that the relationship F3=(d1/(d1+d3))W. In the present embodiment of the invention, where d1=1 unit and d3=4 units, F3=20% W or the arms support 20% of the body weight W. Body position 119 is inclined forward such that the angle n of the back is approximately 45 degrees to the vertical.

Load resistance is imposed upon the crank 54 by sprocket 42 which is connected to a smaller sprocket 80 by chain 82. Flywheel 79 is driven by sprocket 82 and is supported rotatably by shaft 81 which is attached to upright supports 103 and 105. Brake pads 76 and 78 apply frictional resistance to flywheel 79 rotation by mechanism 77 attached to support 72. Load resistance is varied by turning knob 36.

Figure 3:
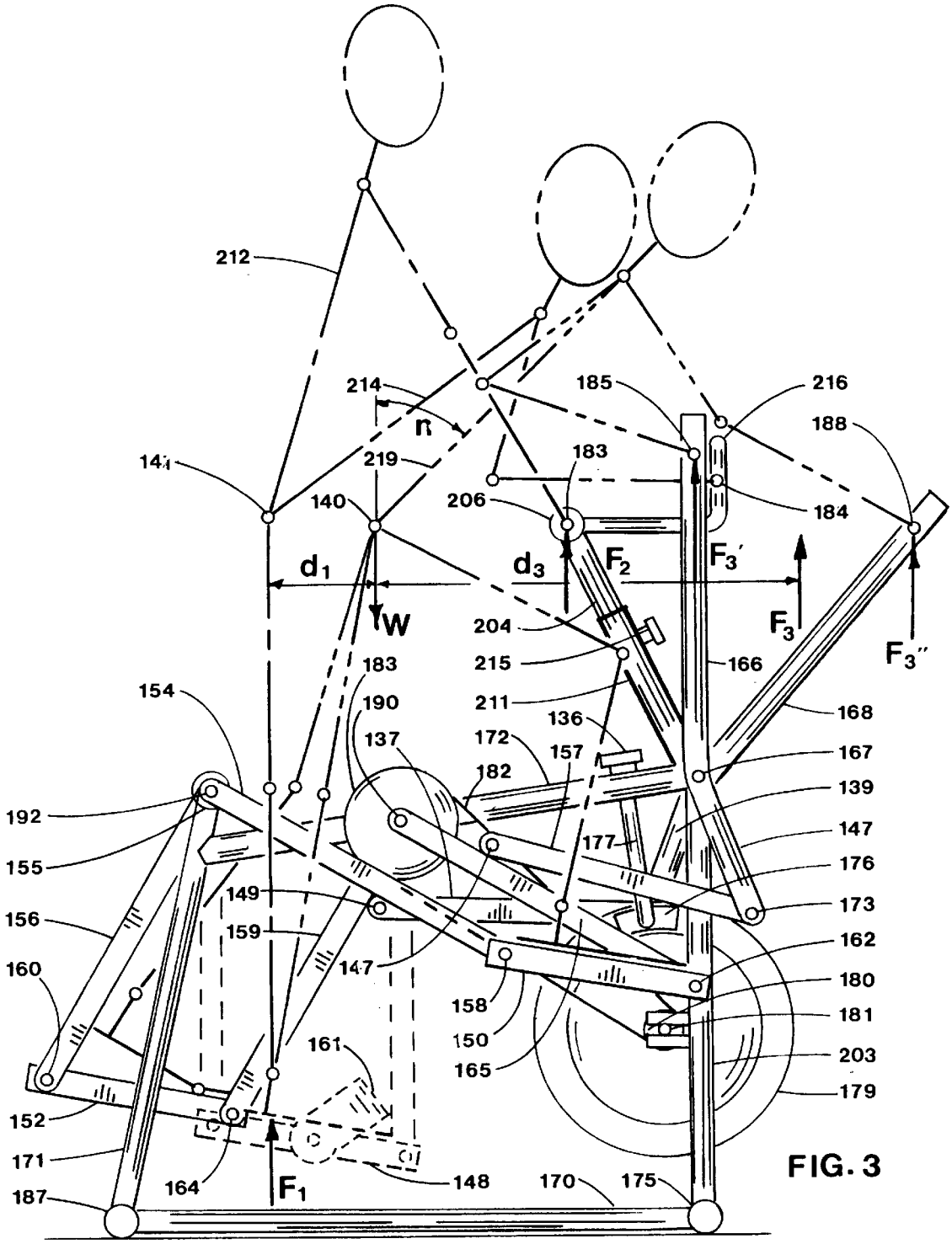
FIG. 3 is a right side elevation view of the alternate embodiment of the present invention.
Figure 4:
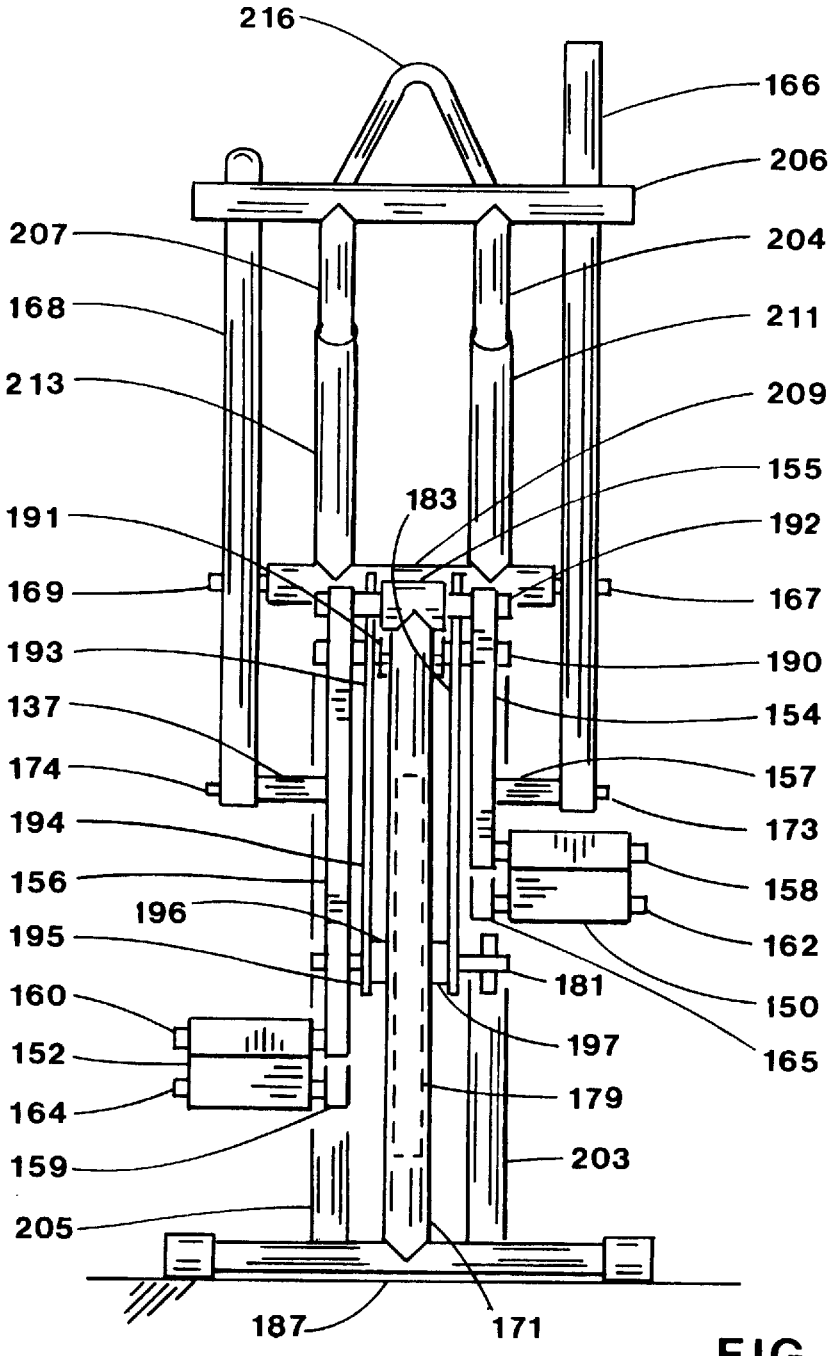
FIG. 4 is a rear view of the alternate embodiment shown in FIG. 3.

Another embodiment of the present invention is shown in FIGS. 3 and 4 where the pedals 150 and 152 are supported by links 154,165 and 156,159, respectively, at pivots 158, 162 and 160,164. Links 154,165 and 156,159 are supported by pivot shafts 192 and 190 which have pivot shaft housing 155 and 191 attached to frame supports 171 and 172, respectively. Pedals 150 and 152 swing in a pendulum type motion to guide the foot from a raised position 150 through the lowermost position 148 following into the rearmost position 152. Lifting the foot against foot strap 161 or 163 (not shown) allow the pedals to return to the starting position 150.

Links 157 and 137 connect links 165,159 to rockers 147,139, respectively, by pivots 147,149 and 173,138 (not shown). Rockers 147,139 pivot about shaft 167 attached to cross member 209 and extend upward at an angle forward of the operator as arm levers 166,168 to support the hands 185,188 during push-up operation 219.

The upright support cross member 209 is attached to upright supports 203 and 205 and frame support 172. Lower cross member 175 is in contact with the floor and is attached to upright supports 203 and 205 and is attached to horizontal support 170. A second lower cross member 187 is in contact with the floor and is attached to support member 170 and 171. The bearing housing 155 is attached to support 171 which is attached to support 172. Bearing housing 191 is also connected to support 172.

Handlebar 206 is attached to support members 204 and 207 which are telescoped into supports 211 and 213 and held secure by detents 215 and 217. Supports 211 and 213 are attached at an angle to the horizontal to upright cross member 209. Handlebar 206 is adjustable in location to facilitate operator positions 212 and 214.

In operator position 212 the hip joint 141 is generally forward the bearing housing 155 while the arms are extended with the hands 183 gripping handlebar 206 causing the back to be somewhat inclined for stand-up cycling. A second operator position 214 is available wherein the operator leans forward to incline the back where the lower arms rest on handlebar 206 which imposes force F2 on the lower arms while the hands 184 grasp the hand grip 216 which is attached to handlebar 206. The handlebar 206 supports a more significant part of the body weight F2 in position 214 when the foot is lifted against foot strap 161 or 163 (not shown) to encourage speed or cruise cycling. The third position 219 of the operator has the hip joint 140 located a distance d1 forward of the foot on pedal position 148 and with the hands 185 and 188 grasping the arm levers 166 and 168 at an average distance d3 from hip joint 140 such that the arm levers support more of the body weight W for push-up exercise cycling.

In the push-up position 219, the body weight W is generally centered near the hip joint 140 acting as a center of gravity. The feet are supported by force F1 while the hands 185 and 188 are supported by force F3 where F3=F3'+F3" as the combined weight supported by the hands 185 and 188. A simple force and moment balance reveal that the relationship F3=(d1/(d1+d3))W. In the present embodiment of the invention, where d1=1 unit and d3=4 units, F3=20% W or the arms support 20% of the body weight W. Body position 219 is inclined forward such that the angle n of the back is approximately 45 degrees to the vertical.

Load resistance is applied to levers 165,159 by sprockets 183,193 attached to levers 165,159, respectively. Chains 182,194 connect sprockets 183,193 to smaller sprockets 180,195 which drive one-way clutches 197,196, respectively. The one way clutches alternately drive flywheel 179 which is supported by shaft 181 attached to frame supports 203,205. Disc pads 176,178 are supported by mechanism 177 and cause adjustable pressure on flywheel 179 by handle 136.

Another embodiment of load resistance would use damping cylinders (not shown) acting upon levers 157,159 and the framework with pivot connections in lieu of a flywheel and disc pads. Other links could also provide suitable connections for damping means.

The motion of pedals 150 and 152 are not coupled in the alternate embodiment shown in FIGS. 3 and 4 allowing independent movement for each foot and arm lever associated with that foot. However, it must be understood that several mechanisms are available in the literature to couple the pedal motions. In the present embodiment of the invention, the right foot motion is coupled to the right arm motion. Mechanisms are also available to reverse the coupling of foot motion to arm lever motion.

What is claimed is:

1. An exercising machine comprising:

a framework means, said framework means being configured to be supported by the floor;

a linkage means, said linkage means containing a plurality of links pivotally connected to said framework means;

a pair of pedal means for standup exercise, each said pedal means having a first pedal pivot means and a second pedal pivot means each operably associated with said linkage means to move said pedal means in a generally back and forth direction;

an arm lever means, said arm lever means mounted to said framework means by a pivot means positioned above said pedal means for up and down movement in a generally inclined direction, said arm lever means being operably associated with said linkage means;

said pedal means coordinated with said lever means to allow said pedal means to move relative to said framework means when the foot of the user is rotating and linkage means whereby the arm lever means movement is substantially forward of said pedal means to support the upper body of the user during standup operation for arm exercise; and wherein the users back can form an incline angle up to about 45 degrees with respect to a vertical plane and the arm lever means can support up to about 20% of the users body weight.

2. The exercise machine according to claim 1 wherein said linkage means comprises a crank link pivotally mounted to said framework means, a rocker link pivotally mounted to said framework means, and a pedal support link pivotally interposed said crank link and said rocker link to form a crank-rocker mechanism, said pedal means being attached to said pedal support link whereby said pedal means moves the foot along a predetermined pedal path.

3. The exercise machine according to claim 1 wherein said linkage means comprises a first link pivotally mounted to said framework means, a second link pivotally mounted to said framework means, and a pedal support link pivotally interposed said first link and said second link, said pedal means being attached to said pedal support link whereby said pedal means moves the foot along a predetermined pedal path.

4. The exercise machine according to claim 1 further comprising a load resistance means operably associated with said linkage means.

5. The exercise machine according to claim 1 further comprising a handle means attached to said framework means having hand grips to balance the upper body.

6. The exercise machine according to claim 5 further comprising an arm rest means attached to said framework means to provide support for the upper arms while the hands grip the handle means.

7. The exercise machine according to claim 1 wherein the arm lever means is positioned forward the operator to incline the body whereby the arms assume at least 15 percent of the body weight.

8. The exercise machine according to claim 1 wherein said pedal means inclines with the base of the foot during operation of said linkage means.

9. An exercise machine comprising:

a framework means, said framework means being configured to be supported by the floor;

an upright support means, said upright support means connected to said framework means;

a crankshaft bearing housing means connected to said framework means, said crankshaft bearing housing means having a crank means projecting outwardly therefrom on both sides thereof;

a rocker means, said rocker means pivotally attached to said upright support means;

a pedal support means, said pedal support means having a foot engaging pedal means attached thereto, said pedal support means being pivotally interposed between said crank means and said rocker means;

an arm lever means, said arm lever means mounted to said upright support means by a pivot means positioned above said pedal means for up and down movement in a generally inclined direction, said arm lever means being operably associated with said rocker means;

said pedal means coordinated with said arm lever means to allow said pedal means to move relative to said framework means when the foot of the user is rotating said crank means whereby the arm lever means movement is substantially forward of said pedal means to support the upper body of the user during standup operation for arm exercise; and wherein the users back can form an incline angle up to about 45 degrees with respect to a vertical plane and the arm lever means can support up to about 20% of the users body weight.

10. The exercise machine according to claim 9 further comprising a load resistance means operably associated with said crank means.

11. The exercise machine according to claim 9 further comprising a handle means attached to said framework means having hand grips to balance the upper body during standup exercises.

12. The exercise machine according to claim 11 further comprising an arm rest means attached to said framework means to provide support for the upper arms while the hands grip the handle means.

13. The exercise machine according to claim 9 wherein said arm lever means is a curved forward extension of said rocker means having a hand grip to support the upper body during standup exercise.

14. The exercise machine according to claim 9 wherein said pedal means inclines the toe of the foot downward during a portion of the operation of said crank means.

15. An exercise machine comprising:

a framework means, said framework means being configured to be supported by the floor;

a first link means, said first link means pivotally connected to said framework means;

a second link means, said second link means pivotally connected to said framework means;

a pedal support means having a foot engaging pedal means attached thereto, said pedal support means being pivotally interposed between said first link means and said second link means;

an upright support means, said upright support means connected to said framework means;

an arm lever means, said arm lever means mounted to said upright support means by a pivot means positioned above said pedal means for up and down movement in a generally inclined vertical direction, said arm lever means being operably associated with said second link means;

said pedal means coordinated with said arm lever means to allow said pedal means to move in a generally back and forth direction relative to said framework means when the foot of the user is rotating said first and second link means whereby the arm lever means movement is substantially forward of said pedal means to support the upper body of the user during standup operation for arm exercise; and wherein the users back can form an incline angle up to about 45 degrees with respect to a vertical plane and the arm lever means can support up to about 20% of the users body weight.

16. The exercise machine according to claim 15 further comprising a connector link means whereby said arm lever means is pivotally connected to said second link means by said connector link means for standup exercise.

17. The exercise machine according to claim 15 further comprising a load resistance means operably associated with said link means.

18. The exercise machine according to claim 15 further comprising a handle means attached to said framework means having hand grips to balance the upper body during standup exercise.

19. The exercise machine according to claim 18 further comprising an arm rest means attached to said framework means to provide support for the upper arms while the hands grip the handle means during standup exercise.

20. The exercise machine according to claim 15 wherein said pedal means inclines with the base of the foot during operation of said link means.

* * * * *